US005143781A

United States Patent [19]

Dunbar et al.

[11] Patent Number: 5,143,781

[45] Date of Patent: Sep. 1, 1992

[54] ANISOTROPIC CONTINUOUS STRAND MATS

[75] Inventors: Sidney G. Dunbar, Granville, Ohio; Lee J. Goss, Huntingdon, Pa.

[73] Assignee: Owens-Corning Fiberglas Corporation, Toledo, Ohio

[21] Appl. No.: 628,128

[22] Filed: Dec. 17, 1990

[51] Int. Cl.[5] ..... B32B 5/04; B32B 5/08; B32B 5/12; C03B 37/02

[52] U.S. Cl. ..... 428/288; 65/4.4; 428/108

[58] Field of Search ..... 65/4.4; 428/108, 288

[56] References Cited

U.S. PATENT DOCUMENTS 3,616,143 10/1971 Langlois ..... 428/228
4,615,717 10/1986 Newbayer et al. ..... 65/4.4
4,955,999 9/1990 Schaefer et al. ..... 65/4.4
4,961,769 10/1990 Miller et al. ..... 65/4.4

*Primary Examiner*—James C. Cannon
*Attorney, Agent, or Firm*—Patrick P. Pacella

[57] ABSTRACT

We have developed a new pattern for continuous strand fiberglass mat which gives improved torsional rigidity to the molded structure. The pattern is basically an elongated elliptical loop where the strands lay on the conveyor and look like lazy whirl formations or concentric circles with diameters dependent upon properties such as bending rigidity and torsional rigidity. The lay-down pattern looks cycloidal in nature. Elongated elliptical strand loops become further elongated until at some point they also contain "pigtails" or somewhat straight strands with small elliptical loops oriented in the cross-machine direction.

10 Claims, 1 Drawing Sheet

ANISOTROPIC CONTINUOUS STRAND MATS

TECHNICAL FIELD

This invention relates to anisotropic continuous strand mats. The anistropic (elongated elliptical loop) mats are preformable and allow for production of structural parts such as automobile bumpers.

BACKGROUND ART

Continuous strand mats have been glass fiber reinforcements for plastics for many years. The mats have strands of infinite length in a random orientation which look like lazy whirl formations with each strand assuming an individualistic pattern or overlapping as coils. The industry gathers the strands on a conveyor, bonds them with a binder, cures and rolls them as flat goods to be shipped to a molder. Laminated moldings with continuous strand mat as reinforcements have isotropic mechanical properties. That is, mechanical properties such as tensile strength, flexural strength and impact strength that are generally identical in all directions. Other stranded glass fiber reinforcements that can be rolled up as flat goods and shipped to molders exist. Examples are chopped strand mat, woven roving, woven glass fiber fabrics, braided strands, and knitted fabrics which are unidirectional, bidirectional or multidirectional. One distinction continuous strand mat has over the other flat goods is that continuous strand mat can be stretched during molding to form complex contoured shapes.

Continuous strand mats have been reinforcements for several molding processes such as matched compression molding, pultrusion, Resin Transfer Molding (RTM) and Structural Reaction Injection Molding (SRIM).

The industry currently is showing renewed interest in the RTM and SRIM processes as efficient methods to produce large complicated shapes for use in the automotive industry. One important feature of the RTM and SRIM processes is that of parts consolidation. Certain automotive parts that previously required one or more steel stampings welded together to make a single part, now can be made as a single part in one operation by using the RTM or SRIM processes. The RTM and SRIM processes have an additional feature of extreme importance. The processes can include other materials such as rigid foam, steel support plates, wiring, and tubing incorporated during the molding process.

One particular example of a large complicated automotive structure is a crossmember structure. This part, which currently has ten steel stampings, can be made as one molding by using the RTM process with glass fiber reinforcements and resins.

Layers of continuous strand mat can form the required shape (preforms). Other materials such as directional reinforcements and blocks of rigid foam can be added to the preform. The preforms and additions are placed in a mold and injected with a catalyzed resin (RTM) to make the crossmember structure.

This large a structure requires added directional reinforcements placed on the bias to this part so that required torsional rigidity may be imparted to the structure. One problem encountered in using directional reinforcements to make a preform is that directional fibers do not have the ability to stretch so as to conform to complex compound contours. What is needed is a directional reinforcement that stretches to conform to complex compound contours.

DISCLOSURE OF THE INVENTION

This invention is an oriented continuous stand mat which stretches to form a shape with complex compound contours. The mat contains directional strands so as to impart torsional rigidity to the molded structure. This invention is a preformable mat that handles and stretches like a nondirectional mat. The anistropic oriented continuous strand mat strands compliment the properties of nondirectional isotropic continuous strand mat strands. This new pattern for continuous strand mats gives improved torsional rigidity to the molded structure.

The pattern is an elongated elliptical loop where the strands lay on the conveyor and look like lazy whirl formations or concentric circles with diameters dependent upon properties such as bending rigidity and torsional rigidity. The lay-down pattern looks cycloidal in nature. Elongated elliptical strand loops become further elongated until at some point they also contain "pigtails" or somewhat straight strands with small elliptical loops oriented in the cross-machine direction, depending on the speed of oscillation which casts the strands perpendicular to a moving conveyor.

BRIEF DESCRIPTION OF THE DRAWING

Reference to the accompanying drawing more fully explains the invention. The FIGURE is a perspective view of the mat of this invention.

The FIGURE shows a roll of preformable continuous strand mat 10. The drawing also shows elongated elliptical loops 12 oriented in the cross machine direction. Somewhat straight strands 14 containing "pigtails" also appear in the drawing.

Figure 1:
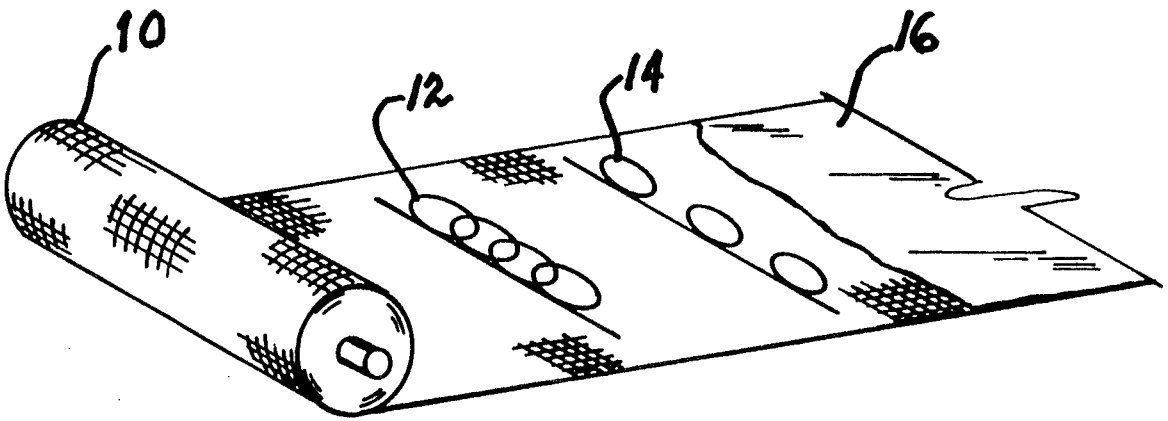

The drawing also pictures binder matrix 16. Binder matrix 16 is a thermosetting binder such as polyester, a thermoplastic binder such as another type of polyester or a combination thereof. A conventional applicator usually applies binder matrix 16 in powder form.

Mats containing the binder matrix are heated such that the thermosetting binder is cured and hardened while the thermoplastic binder softens and flows around the strand intersections. Upon removal from the heat, the mat is cooled to solidify the thermoplastic binder portion of the matrix. The cooled thermoplastic binder and the cured thermosetting binder give the mat the necessary strength for additional handling for packaging and for subsequent handling by the customer.

The mat formed according to the present invention is particularly useful in producing automobile bumper moldings since placing a mat in a mold can consume a major portion of molding time. The mat normally has to be placed by hand into the mold and tucked into corners and areas of curvature. A mat which has been formed on a flat conveyor retains its flat "memory" and resists bending to shape and often springs out of the mold or bends away from the desired shape. In contrast, our preformable mat, when set to the desired shape, will retain that shape and will not spring out of the mold or bend away from the desired shape.

DETAILED DESCRIPTION OF THE INVENTION

The continuous strand mat process is well known in the industry. See U.S. Pat. Nos. 3,318,746 and 3,616,143. A pullwheel operating at a specific surface speed attenuates fibers from a molten reservoir and then after quenching, adding chemical sizings, and gathering into strands, casts these strands onto a moving foraminous conveyor. While the conveyor is moving in the machine direction, the pullwheel or a number of pullwheels casts the strands in an oscillating manner in a direction perpendicular to the conveyor movement. The strands oscillate back and forth across the conveyor at a specific speed. The patterns the strands lay on the conveyor are lazy whirl formations or concentric circles. The lay-down pattern is cycloidal in nature and has random orientation providing isotropic properties.

Normally the speed of oscillation which casts the strands perpendicular to the movement of the conveyor is set to a speed which promotes complete and even coverage of the conveyor. If one measures the pullwheel speed in terms of feet-per-minute, there occurs a loop formation ratio (LFR) which is pullwheel speed divided by the oscillating speed. Normally this LFR is greater than a value of 6.5 to 7.0 and round loops are deposited on the conveyor which promote isotropic properties.

We have reduced this ratio to the 4.0 to 5.5 range. The loops become elongated elliptical strand loops and laminate mechanical properties become increasingly anisotropic as they increase in the cross-machine direction and decrease in the machine direction. As the LFR value further decreases to less than 3.5, the elongated elliptical strand loops become further elongated until they also contain "pigtails" or somewhat straight strands with small elliptical loops oriented in the cross-machine direction. Mechanical properties become increasingly anisotropic in nature.

If the ratio were to decrease to 1.0, the pullwheel speed would then be equal to the oscillator speed and the strand lay-down pattern would be a straight strand laid in a path perpendicular to the direction of conveyor travel. Strength orientation would be all in the cross-machine direction. Additionally, the mat would show poor machine direction strength which would negatively impact mat handling properties such as rolling up, unrolling and conveying mat to preforming equipment. The mat at a LFR of 1.0 would contain all straight strands and hence not have the capability of being stretched to conform to complex compound contours. Therefore, the LFR must be greater than 1.0 and less than 6.5 to provide sufficient anistropy so that the molded structure will contain the required torsional rigidity.

The anistropic mat we produced contains increased strength in the cross-machine direction or the 90° direction with reduced strength in the machine direction or the 0° direction. Torsional rigidity requires that directional reinforcements be placed on the bias to the structure or in the +45° and −45° directions. To accomplish this, we alternate layers of preformable mat rotated + and −45° prior to cutting out the pattern which we will subsequently preform in to a complex compound contoured shape.

INDUSTRIAL APPLICABILITY

The preformed shape can then be combined with other inserts such as rigid foam and steel support plates and enclosed in an RTM mold and subsequently injected with the proper catalyzed resin. The cured part when removed from the mold will then provide the required mechanical properties including torsional rigidity provided by the anistropic preformable continuous strand mat.

EXAMPLE

To evaluate our concept of producing an anistropic mat, we produced continuous strand mat at a weight of 1.5 oz/ft$^2$ and a width of 55" using pullwheel speeds of 3587.7 ft. per minute and an oscillating speed of 1356.6 fpm. This produced mat with an LFR of 2.64.

Laminates made from the above mat were tested in the 0° and 90° directions for tensile strength and tensile modulus with the following results being achieved:

| | 0 Degrees | 90 Degrees |
|---|---|---|
| Tensile Strength (psi × $10^3$) | 18.5 | 25.3 |
| Tensile Modulus (psi × $10^6$) | 1.4 | 1.9 |

Our anisotropic preformable continuous strand mat allows preforms to be made in one step, which when molded in a 6-minute cycle provides a structural laminate such as crossmember that has the required torsional stability.

We claim:

1. An anisotropic preformable continuous strand mat comprising continuous strands of glass fiber filaments, the strands having an irregular pattern of elongated elliptical strand loops in the mat oriented in a cross-machine direction that also contain somewhat straight strands with "pigtail" ends also oriented in a cross-machine direction wherein the mat has a loop formation ratio (LFR) greater than 1.0 and less than 6.5.

2. A preformable continuous strand mat according to claim 1 that contains increasingly elongated elliptical strand loops oriented in a cross-machine direction having an LFR ranging from 4.0 to 5.5.

3. A mat according to claim 1 capable of being stretched to conform to complex compound contours.

4. A plurality of mats according to claim 1 having desirable torsional rigidity wherein a number of the mats are rotated +45° and −45° from the machine direction.

5. A mat according to claim 1, including a binder matrix.

6. A mat according to claim 1, including a binder matrix of a thermosetting binder, a thermoplastic binder or a combination thereof.

7. A preformable continuous strand mat according to claim 1 that contains somewhat straight strands with "pigtail" ends oriented in a cross-machine direction having an LFR ranging from 1 to 3.5.

8. Laminates made of a plurality of mats according to claim 7 having desirable tensile strength and tensile modulus in the machine direction (0°) and cross-machine direction (90°).

9. An anisotropic, preformable continuous strand mat of comprising strands of glass fiber filaments, the strands having an irregular pattern of elongated elliptical strand loops in the mat oriented in a cross-machine direction that contains somewhat straight strands with "pigtail" ends also oriented in a cross-machine direction, the mat having loop formation ratio (LFR) of 2.65.

10. Laminates made of a plurality of mats according to claim 5 having desirable tensile strength and tensile modulus in the machine direction (0°) and cross-machine direction (90°).

* * * * *